US007083553B2

(12) United States Patent
Leon

(10) Patent No.: US 7,083,553 B2
(45) Date of Patent: Aug. 1, 2006

(54) MULTI-BELL WEIGHT LIFTING DEVICE

(76) Inventor: Ramon Leon, 9 Ridgeley Pl., Weehawken, NJ (US) 07086

( * ) Notice: Subject to any disclaimer, the term of this patent is extended or adjusted under 35 U.S.C. 154(b) by 499 days.

(21) Appl. No.: 10/609,824

(22) Filed: Jun. 30, 2003

(65) Prior Publication Data

US 2004/0266592 A1 Dec. 30, 2004

(51) Int. Cl.
*A63B 21/072* (2006.01)
*A63B 21/075* (2006.01)

(52) U.S. Cl. ..... 482/106; 482/93; 482/98; 482/107; 482/108

(58) Field of Classification Search ..... 482/93, 482/94, 104, 106–109, 908, 98
See application file for complete search history.

(56) References Cited

U.S. PATENT DOCUMENTS 1,366,200 A * 1/1921 Matysek ..... 482/106
4,712,793 A * 12/1987 Harwick et al. ..... 482/99
5,102,124 A * 4/1992 Diodati ..... 482/107
5,131,898 A * 7/1992 Panagos ..... 482/108
5,171,199 A * 12/1992 Panagos ..... 482/106
5,464,379 A * 11/1995 Zarecky ..... 482/108
5,588,942 A * 12/1996 Dillard ..... 482/139
6,083,144 A * 7/2000 Towley et al. ..... 482/107
6,379,286 B1 * 4/2002 Scopino et al. ..... 482/93
6,599,222 B1 * 7/2003 Wince ..... 482/106
6,837,833 B1 * 1/2005 Elledge ..... 482/108
6,872,173 B1 * 3/2005 Krull ..... 482/108

FOREIGN PATENT DOCUMENTS

GB 2413288 A * 10/2005

* cited by examiner

*Primary Examiner*—Gregory L. Huson
*Assistant Examiner*—Victor K. Hwang

(57) ABSTRACT

The dumbbell is a weight lifting device. The dumbbell comprises a one piece barrel having integral metal alloy blocks on either side. Transverse and integral holes on the blocks on the end allow insertion of common or modified weight lifting bars. Integral holes on the blocks also have the property of being able to thread in weight slugs of varying poundage and designs in various combinations with the aforementioned weight lifting bars lifting bars. The barrel or handle has a threaded insert in the middle providing the insertion of a ring attachment that would provide an alternate means of mounting on a weight lifting bar. The dumbbell can be mounted on a weight lifting bar via the transverse holes on either head or thru the removable attachment on the handle.

12 Claims, 17 Drawing Sheets

Side

Top
Allen Key
Slot allen key wrench for weight slug removal

MULTI-BELL WEIGHT LIFTING DEVICE

BACKGROUND OF THE INVENTION

Nearly everyone works out in one form or another. Generally dumbbells have very limited usage taking up a large amount of space if they are of one piece or using up valuable pieces if composed of plate metal. They can become a time consuming part of any workout if plate metal must be changed for whatever reason. There is often not enough room in the common apt. to accommodate solid dumbbells of varying poundage.

Most have to make do with the drudgery of using plate metal and adjusting routines to the amount of weight changes one must make. This all makes for an inefficient way of maintaining bodily fitness.

The cumbersome and potential damage to the spine of lifting common flat plate metal off floors makes many switch to other forms of physical fitness such as swimming, jogging etc.

The present invention hopes to utilize a multi purpose tool for maintaining fitness that has versatility, ease of use and a degree of safety that cannot be maintained in your average homes with the clutter of pieces of equipment that must be made available within a limited space.

The use of the multi-bell will not only decrease the amount of space needed for a workout it will save time and eliminate some if not all the equipment necessary. Inclination to adapt workouts to the multi-bell to the exclusion of any other piece of equipment would be the sole domain of individual preference.

The simplistic design of the weight slugs allow for quick and simple insertion and removal in that the shank of the weight slugs act as the guide for the threaded head. Simply pushing in the shank allows for the threads to line up with a flick of the wrist. This is a must for the individual that wants the maximum workout in the least amount of time. Many people tend to make excuses and it is the intent of this product to produce the least amount of excuses possible to make working out more attractive.

The popularity of bodybuilding and aerobics being what it is this invention addresses the problem of those on the fly and live in small habitats. Although the uses of dumbbells have in the past been strictly limited this invention focuses on making a hereof simple product and making it fulfill virtually every aspect of weightlifting.

First of all it encompasses the qualities of having a dumbbell that one can basically edge up in increments of 2–20 pounds on a basic multi-bell without having to clutter your house with normal dumbbell differing in weight by only 5 lbs. The latter could become very expensive and annoying in that the average spare room is very small or just non existent. Also in its favor is the fact that one could just buy attachment weight slugs and store them very easily as well as buy them inexpensively. The weight properties of an individual dumbbell could also be customized by buying different weight slugs and make it an individual preference right off the shelf. So one pair of multi-bells could be the only ones a person need buy.

The average individual must buy 5 pairs of dumbbell just to have an increment of 25 lbs. In total a storage of 10 pairs of dumbbells must be accommodated. The space and money required for this reason alone makes one hesitate before buying the traditional solid dumbbells.

Secondly one could easily appreciate the flexibility of the multi-bell in that it could be used in conjunction or to some extent to the exclusion of normal weight lifting plates.

a) The multi-bell could used on a conventional bench by taking out 2 slugs or 1 long slug that penetrates the length of the multi-bell head on either end.

b) With the use of special bars it can be used for curling weights (Lifting with a bar using two bands). Eliminating the need or at least curbing the amount of plate metal one need store in a confined space.

c) It could remain in its heaviest mode (all weight slugs on it) and still be mounted on a weight bench thru the use of a removable ring attachment on the handle.

d) By varying the amount of flexibility in the multi-bell it could in a simplistic mode be made with a transverse hole thru the heads on either end to allow one to bench or use them by the more traditional methods a dumbbell might be used. ie., . . . A professional gym might not want the small slugs strewn around their gym but would appreciate the flexibility of being able to press the multi-bell into service should there become a shortage of regular plates. Anyone that has gone to a gym has had this happen to them causing frustration and loss of time. Not to mention the stress of having to borrow or take them from someone else.

e) By varying the amount of flexibility in the multi-bell it could in a simplistic mode be made by having the ring attachment permanently attached. Lifting would be accomplished by putting your fingers around the ring. The ring would be contoured to minimize discomfort and awkwardness.

1) The multi-bell could be used on most popular weight lifting machines by having them slide thru 2 bars. (One on each head to eliminate movement that might bother the would be lifter). On a bench movement would be minimized by tightening or loosening the distance between multi-bells or using a plate for stability).

g) Another aspect that could be enjoyed by the multi-bell is the privacy in a gym of using one with a rubber cover on each end that would be of service as follows . . . .

1. Fashionable

2. Safer in that the material if made of rubber would make it easier on floors and individuals should the multi-bell come in contact with objects or people.

3. The never before realized fact that someone might not wish to have others know what he or she is lifting. Privacy being an issue never addressed in public gyms. This is something I've never come across in a gym. People who lift heavy have always been the one to stand out making novices feet uncomfortable.

The multi-bell could depending on attachments have an additional 20 or more pounds on them so one can see that in a social environment it may have its merit in a gym environment. One would need to guess or approximate the amount an individual is lifting. A small but admittedly welcome social advantage in the stressful gym atmosphere.

SUMMARY OF THE INVENTION

The multi-bell is a modern weight lifting tool made of a metal alloy strong enough to support the pressures that would be incurred by its use. It would comprise the main base section or the multi-bell itself. Subsequent parts would be various weights or designs of weight slugs and the attachment ring that can be mounted on a workout bench or stand.

The weight slugs would be comprised of a metal shank of various lengths and the male threads located on the head of the shank. These would be screwed in the female threads located around the hole located at each flat side of the multi-bell. The shanks of weight slugs being of a close tolerance to holes located in multi-bell would naturally align the dreads around the weights slugs. The result would be easy insertion of said slugs into the multi-bell base.

The ring attachment that inserts into rod in center of multi-bell would be of a high tensile strength steel that would serve the dual purpose of securing multi-bells vertically or metal plates and multi-bells horizontally. This would be efficient as they could be used with flat plates or multi-bells thus saving on clutter located in the confined space of some workout rooms. Safety is always an issue in confined areas.

The multi-bells accessories would be the cover for ends covering the entire head on either end, the aforementioned ring attachment, modified weight lifting bars (long and short) and the various designs and poundage of weight slugs.

BRIEF DESCRIPTION OF THE DRAWINGS

FIG. 6A shows exploded view of adapter ring with bit in allen key.

DESCRIPTION OF THE EMBODIMENT

Figures 1, 1A, 1B:
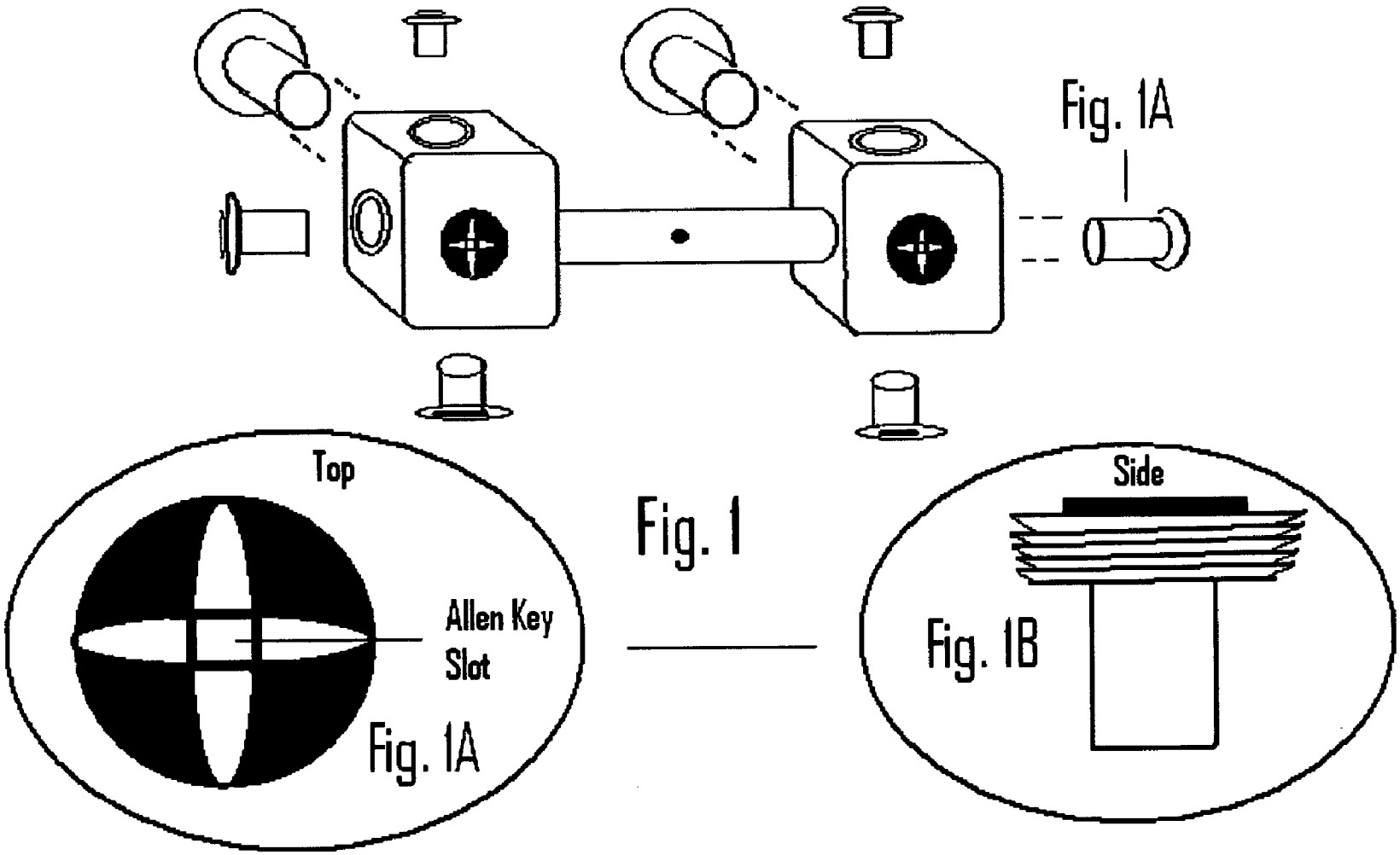
FIG. 1 is view of the basic parts of the multi-bell
FIG. 1A is a top view of weight slug.
FIG. 1B is a side view of weight slug.
Figure 2A:
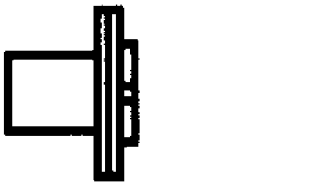
FIG. 2A is a view of the weight slug type used in FIG. 2.
Figure 2B:
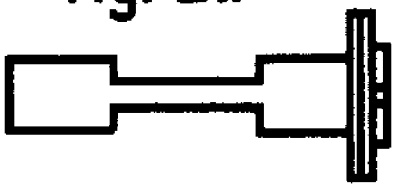
FIG. 2B is a view of a an extended version of a weighted slug this negates the aced for having slugs on either end of the multi-bell heads FIGS. 2C and 2D respectively show heavier versions of weighted slugs that can be used. These can be of the extended type with modified shanks also for max. weight balance.
Figure 2D:
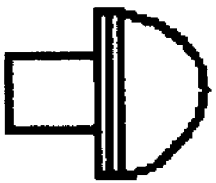
FIG. 2 is a basic view of the multi-bell.
Figure 2C:
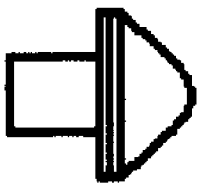
Figure 2:
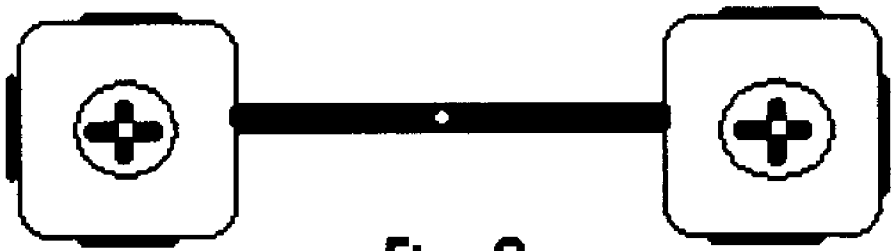
Figure 3:
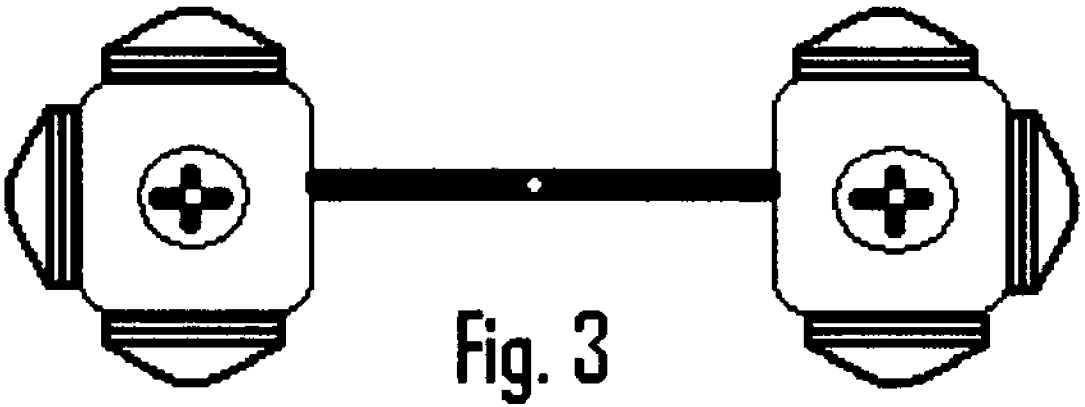
FIG. 3 shows the multi-bell with heavier removable weight slugs of the FIG. 2C type.
Figure 4:
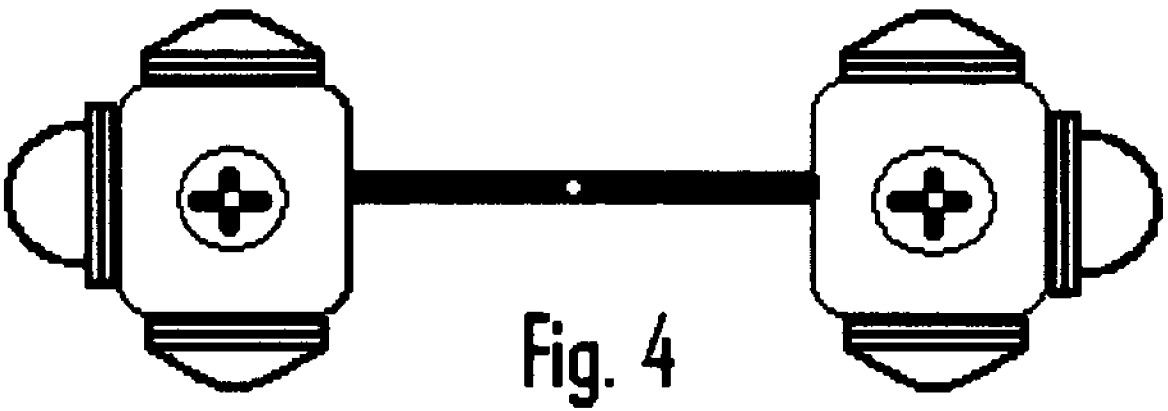
FIG. 4 shows the multi-bell with a combination of removable weight slugs of the FIG. 2C and FIG. 2D type.
Figures 5, 5A:
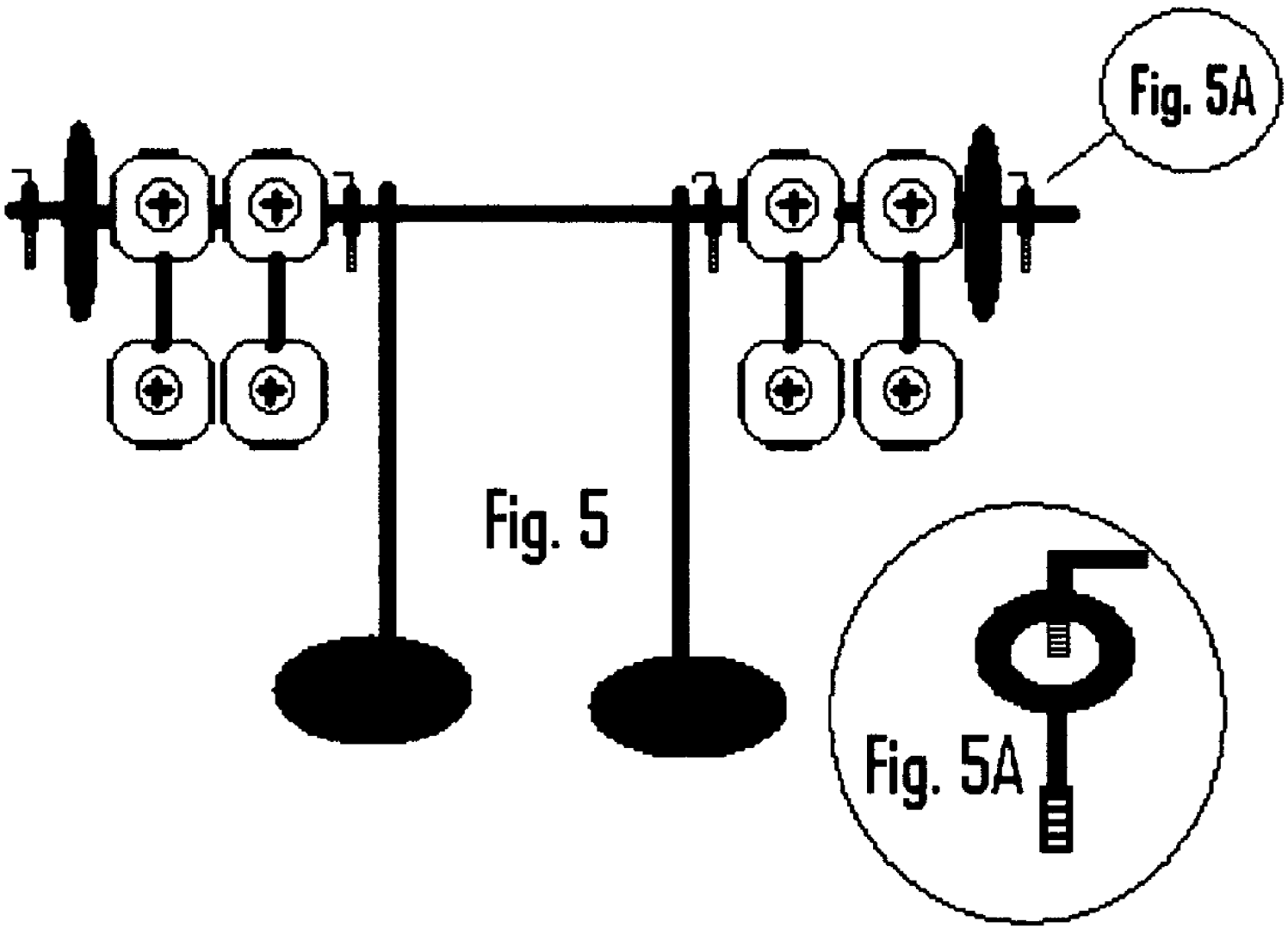
FIG. 5 shows the multi-bell in its alternative use as a metal plate on a workout stand.
FIG. 5A shows the ring adapter in an exploded view.
Figure 6:
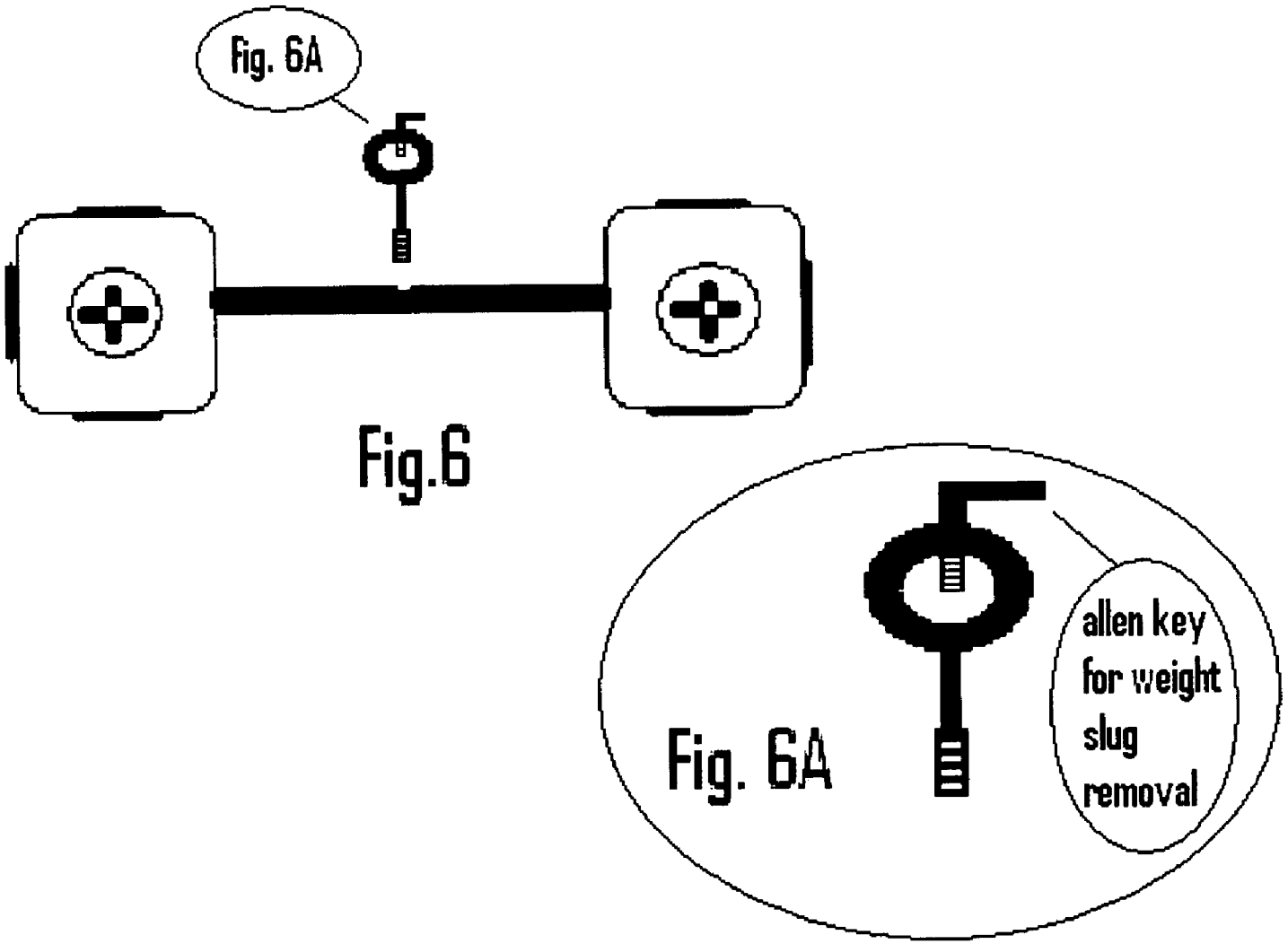
FIG. 6 shows the ring adapter prior to insertion. (This ring would serve the dual purpose of holding weights on a stand and able to be inserted on the multi-bell.)
Figure 7:
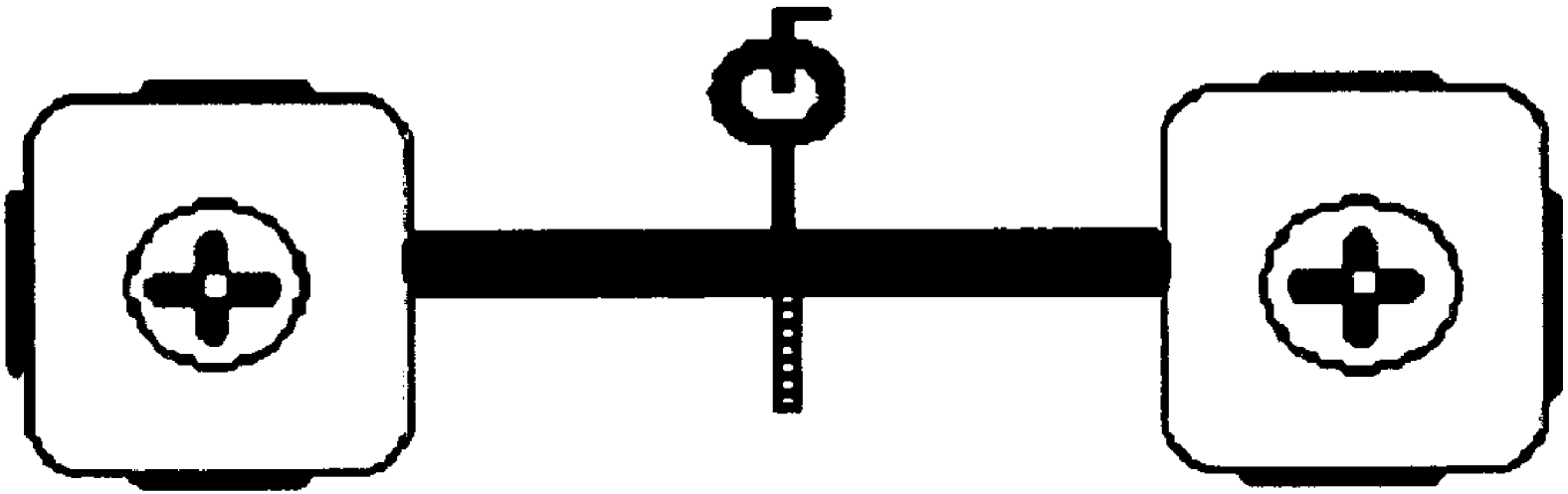
FIG. 7 shows the ring adapter inserted into multi-bell. (The threads normally would not extend thru grip. It is shown as a visual aid.)
Figure 8:
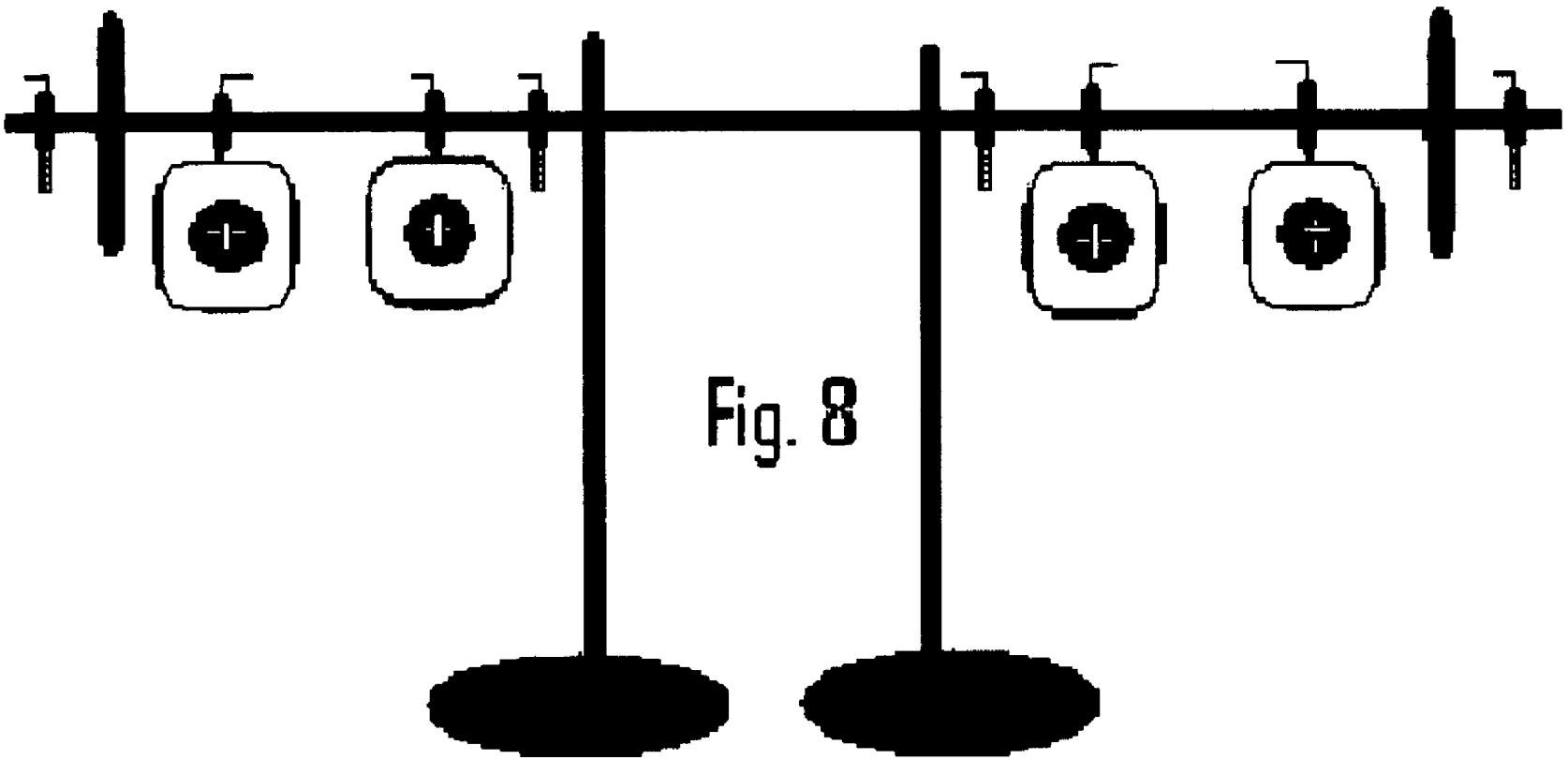
FIG. 8 shows the multi-bell on workout stand using ring adapter and its capability to be tightened on weight stand.
Figure 9:
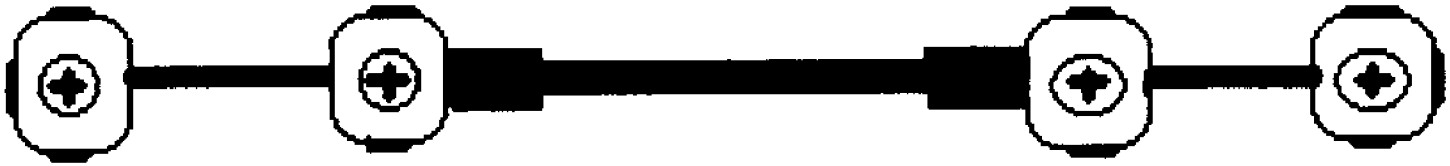
FIG. 9 shows the multi-bell on a modified weight lifting with rotating cuffs for easier insertion and removal.
Figure 9A:
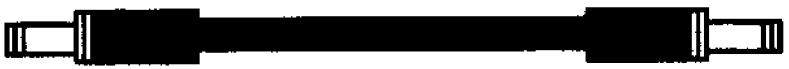
Figure 10:
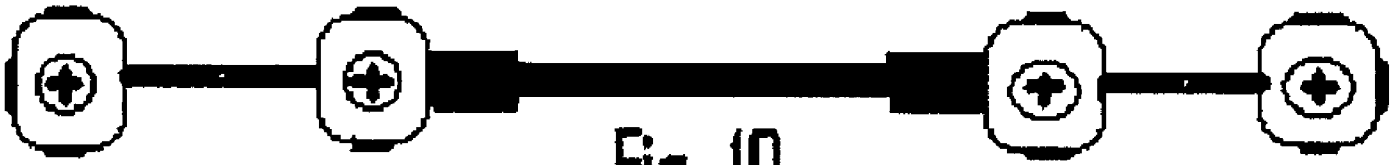
FIG. 10 again shows the multi-bell on modified weight lifting bar.
Figure 11:
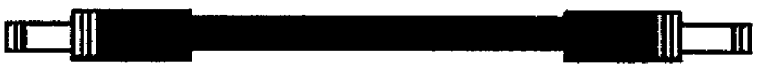
FIG. 11 shows modified weight lifting bar with rotatable sleeves.
Figure 12:
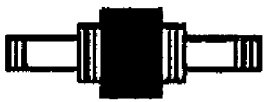
FIG. 12 shows shorter version of modified weight bar.
Figure 13:
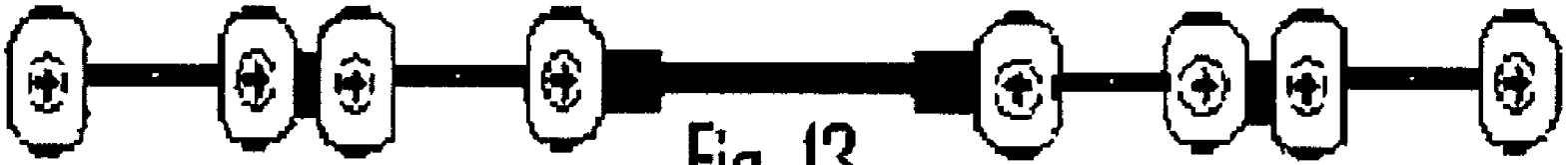
FIG. 13 shows modified weight lifting bar combined with FIG. 12 shorter version on ends.
Figure 14:
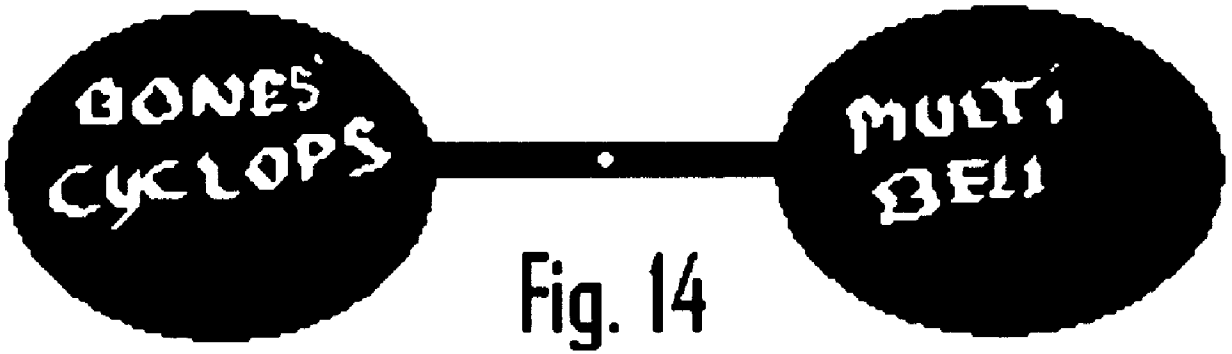
FIG. 14 shows multi-bell with rubber cover on both ends.
Figure 15:
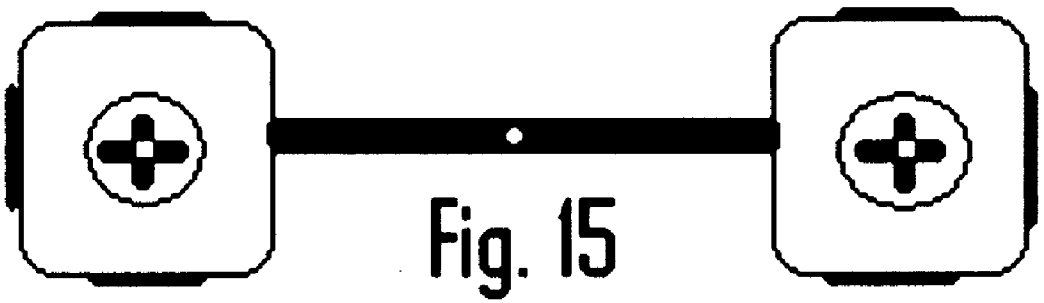
FIG. 15 shows multi-bell without rubber cover.
Figure 16:
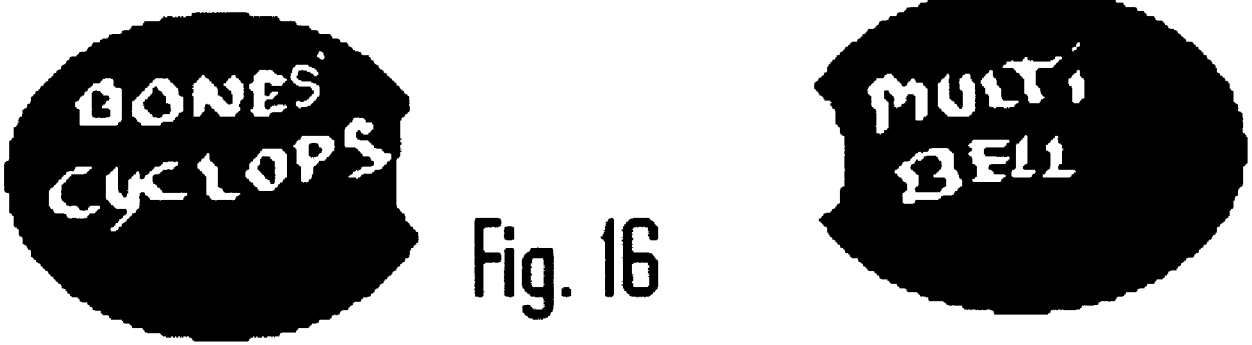
FIG. 16 shows rubber covers removed from multi-bell.
Figure 17:
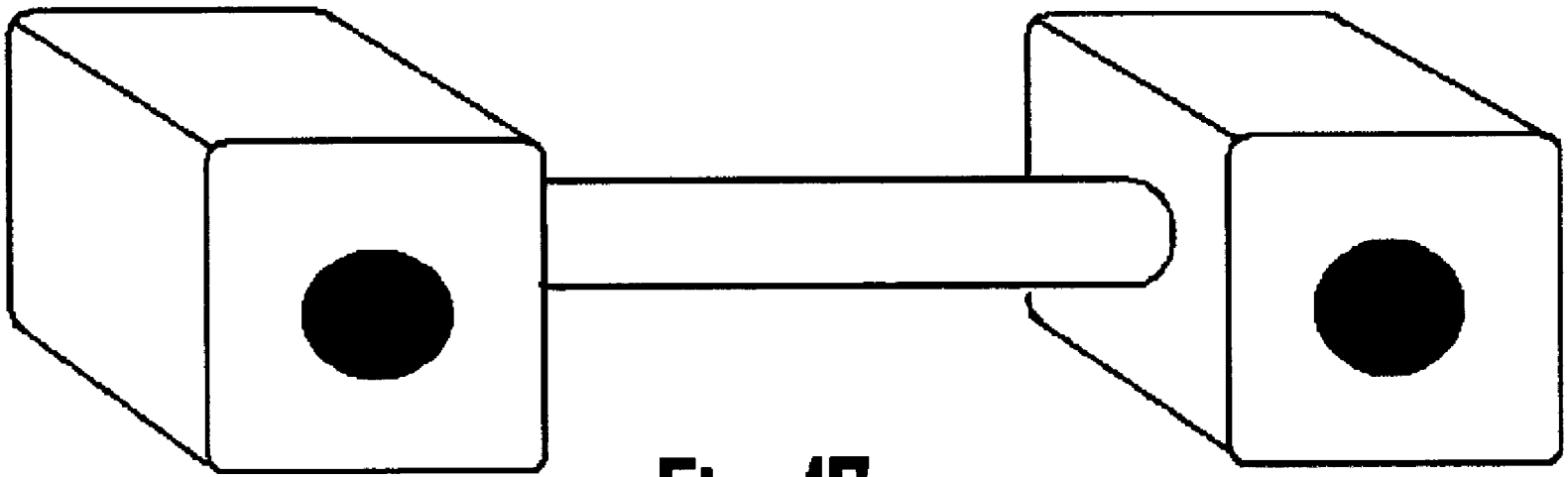
FIG. 17 shows multi-bell in most simplistic version suitable for gyms and spas.
Figure 18:
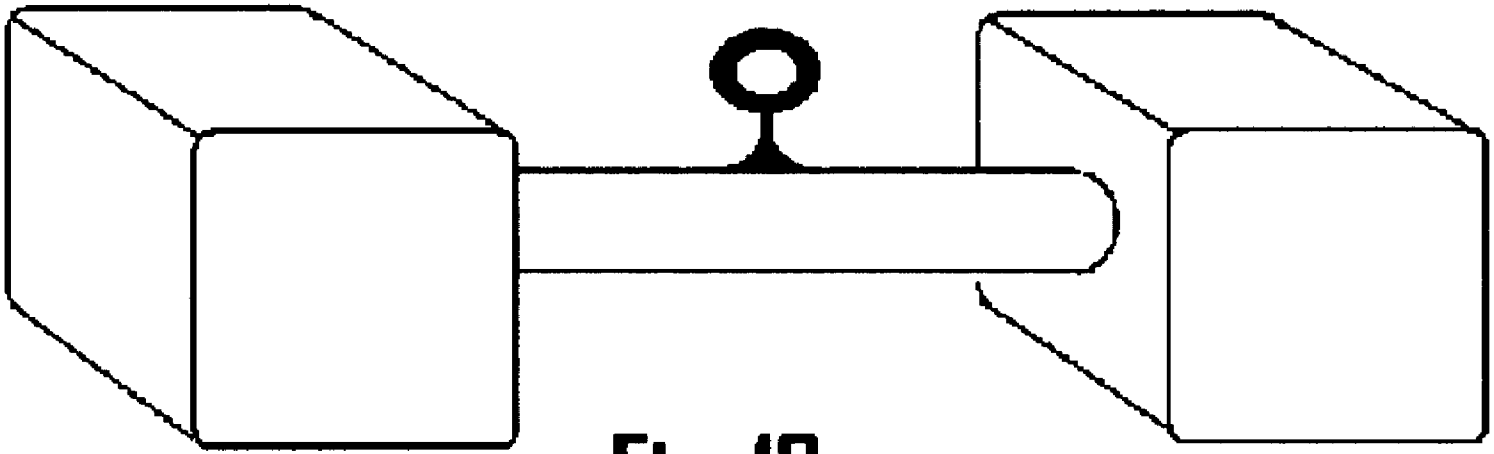
FIG. 18 shows multi-bell in a simplistic version with just a contoured ring adapter. This would still allow it to be mounted on a weight lifting bench and be functional as a normal dumbbell. (This version would ha-e a permanent ring adapter installed, and could be used in conjunction with all other versions or in simplistic mode.)
Figure 19:
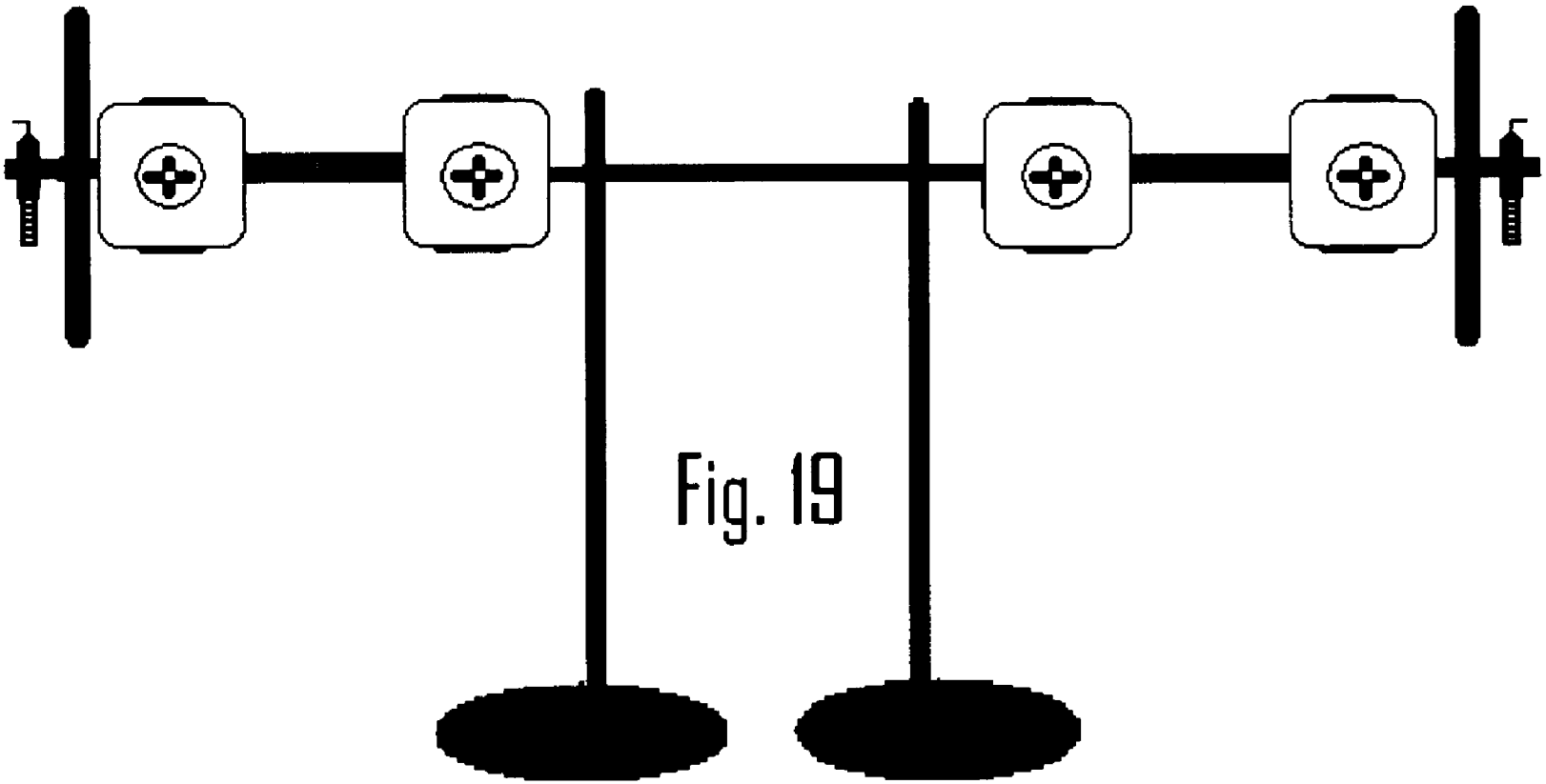
Figure 20:
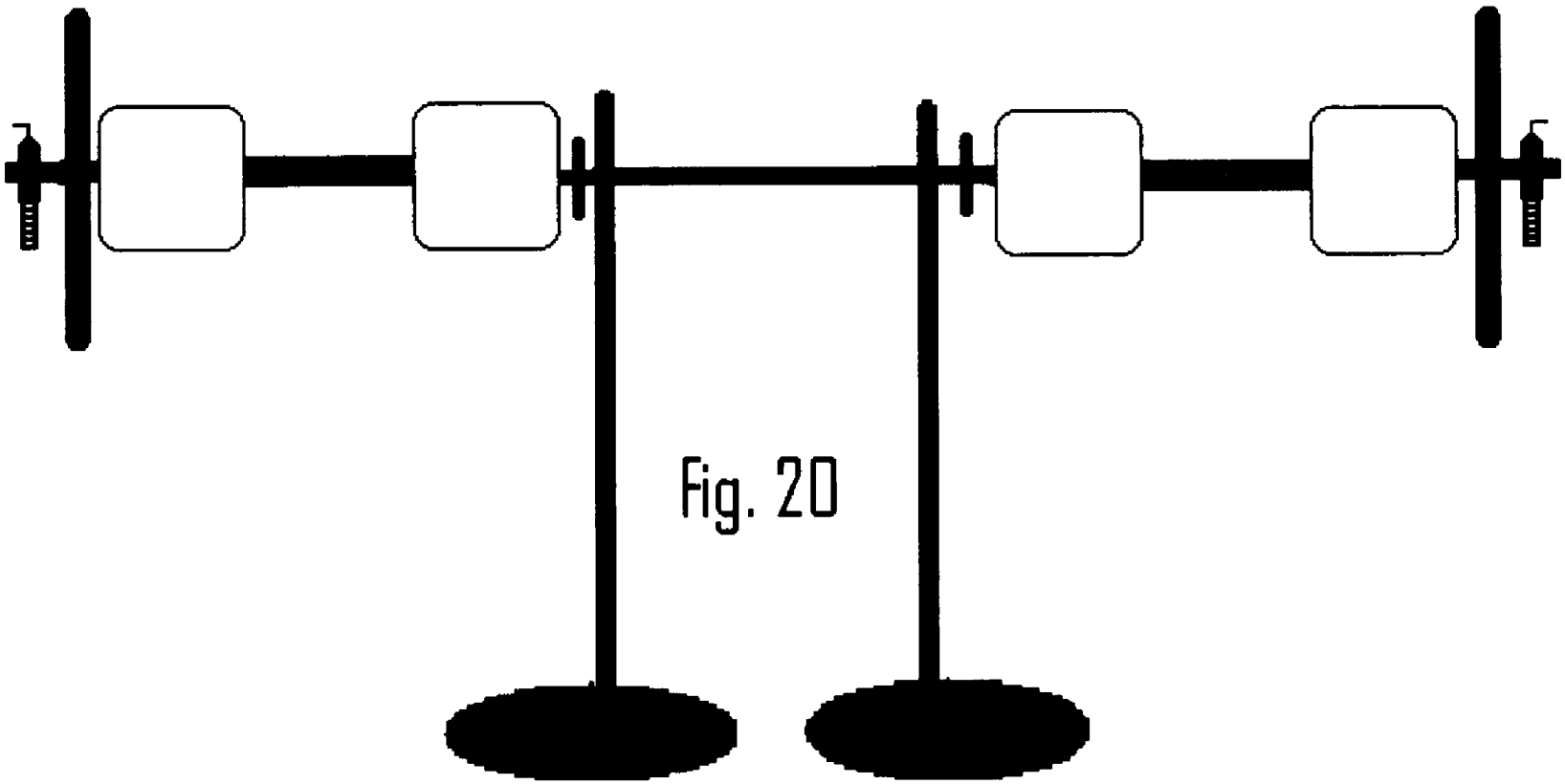
Figure 21:
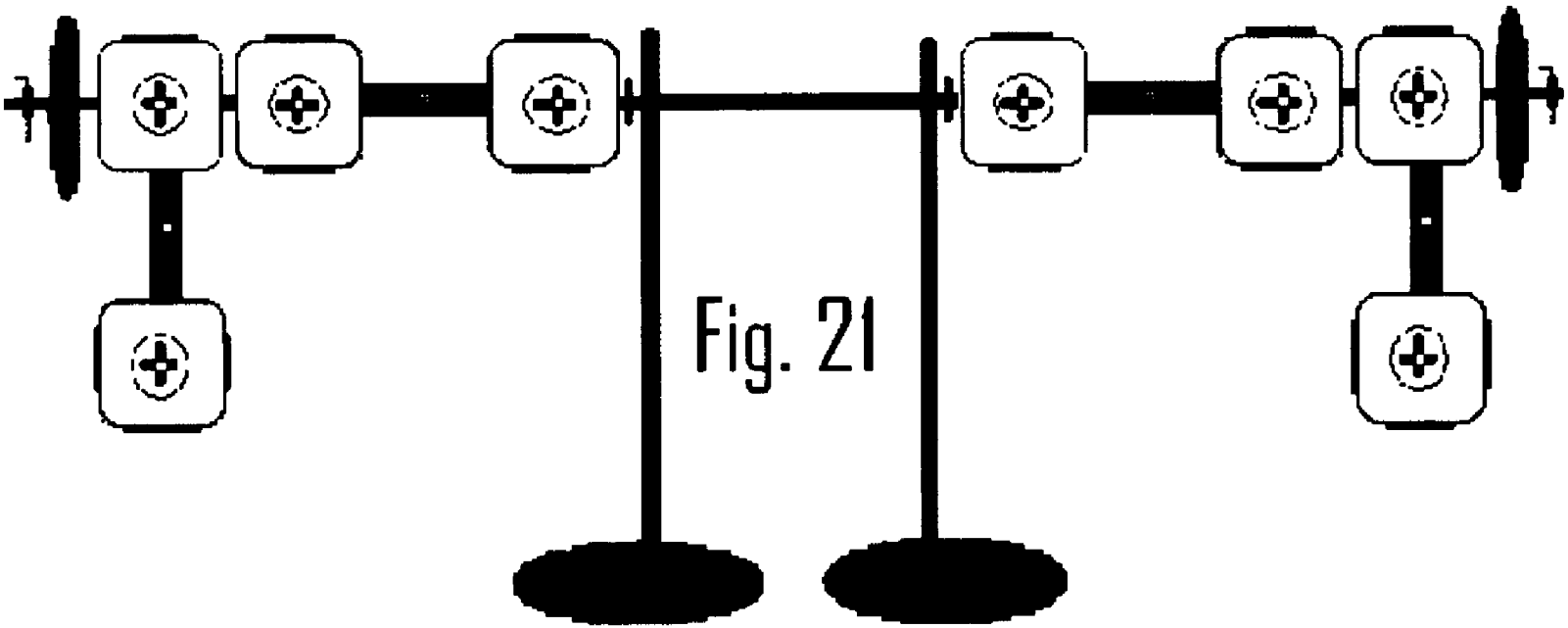
Figures 22, 22A:
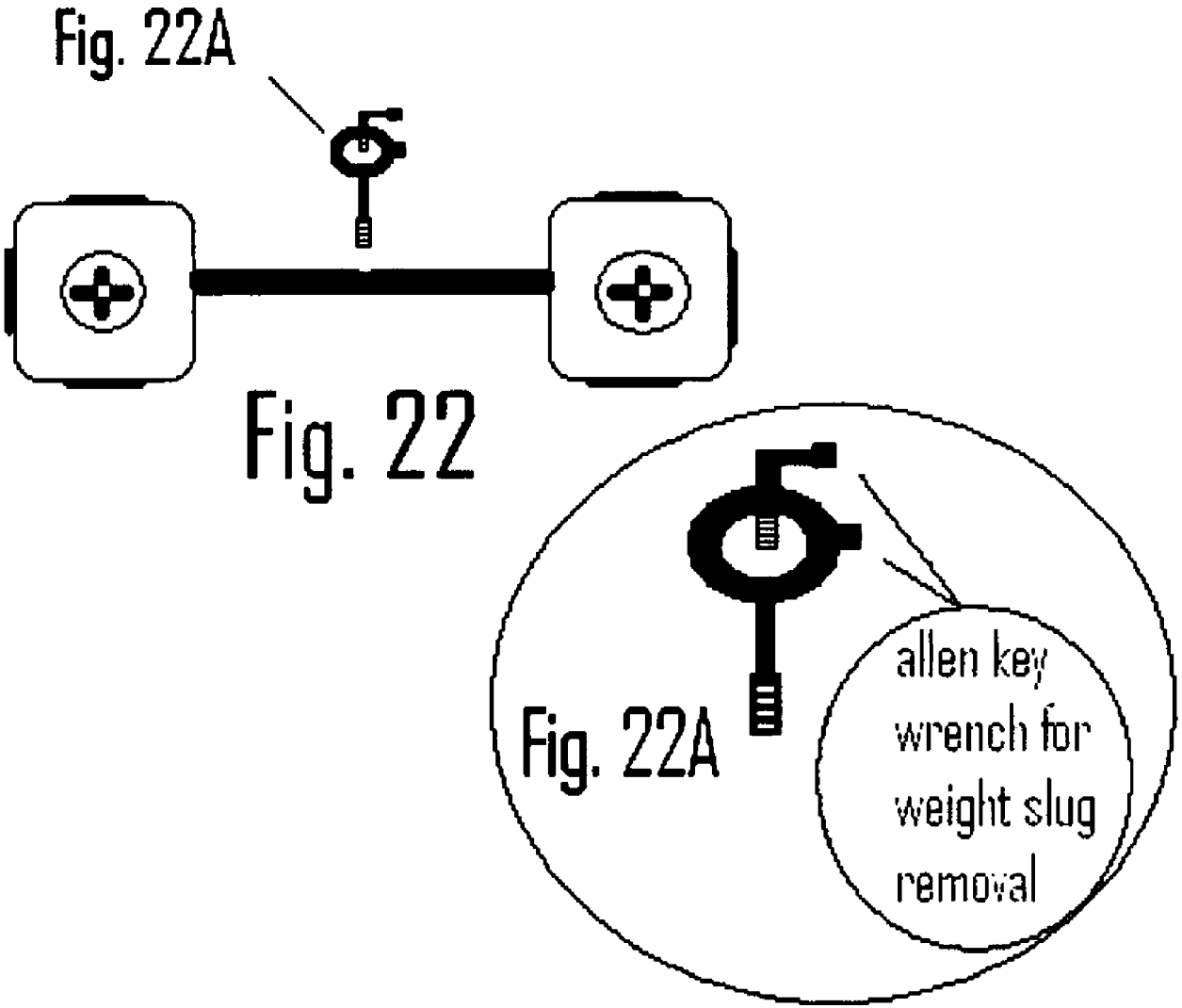
Figure 23:
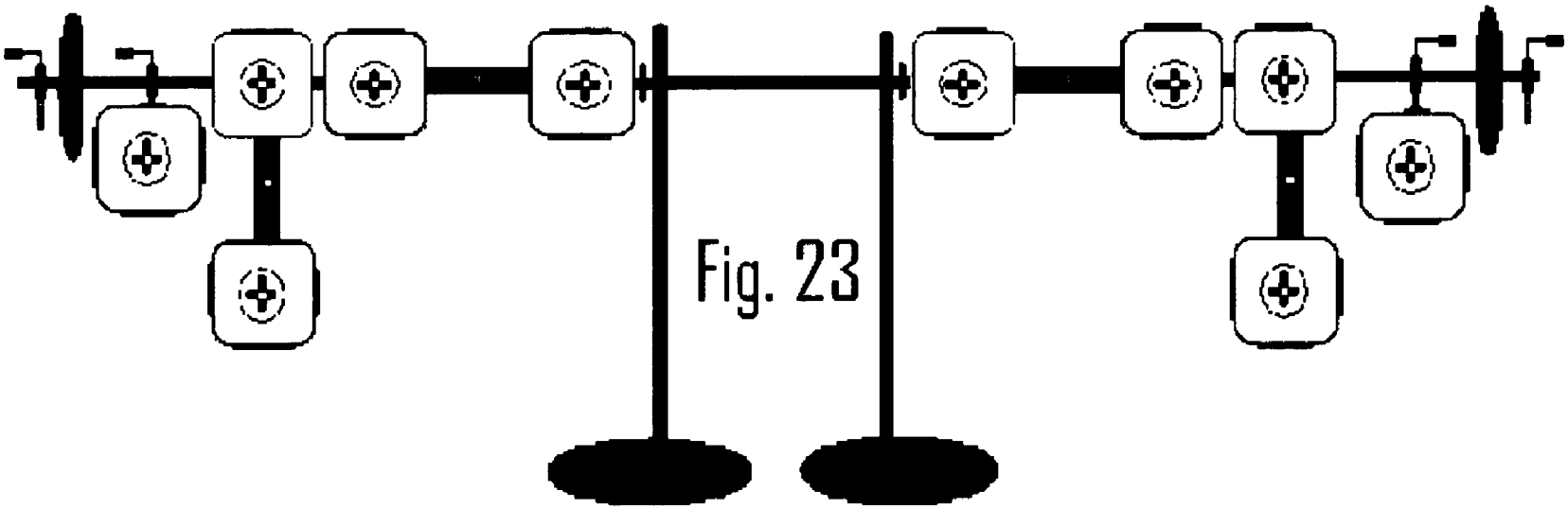

The popularity of bodybuilding and aerobics being what it is this invention addresses the problem of those on the fly and live in small habitats. Although the uses of dumb bells have in the past been strictly limited this invention focuses on making a hereof simple product and making it fulfill virtually every aspect of weightlifting.

First of all it encompasses obviously the qualities of having a dumbbell that one can basically edge up in increments of 2–20 pounds on a basic multi-bell without having to clutter your house with normal dumbbells differing in weight by only 5 lbs. The latter could become very expensive and annoying in that the average spare room is very small or just non existent Also in its favor is the fact that one could just buy attachment weight slugs and store them very easily as well as buy them inexpensively. The weight properties of an individual dumbbell could also be customized by buying different weight slugs and make it an individual preference right of the shelf. So one multi-bell could be the only one a person need buy. The average individual must buy 5 pairs of dumbbell just to have an increment of 25 lbs. In total a storage of 10 dumbbells must be accommodated. The space and money required for this reason alone makes one hesitate before buying the traditional solid dumbbells.

Secondly one could easily appreciate the flexibility of the multi-bell in that it could be used in conjunction or to some extent to the exclusion or normal weight lifting plates.

a) The multi-bell could be used on a conventional bench by taking out 2 slugs or 1 long slug that penetrates the length of the multi-bell head on either end.

b) The multi-bell could be used on a conventional bench in two forms one with threaded insert attachment in center of multi-bell located on the handhold or thru the hole accommodated thru each head on the multi-bell thru removal of weighted slug or slugs. This would be done either for more balanced weight purposes as a personal preference. Or to use the multi-bell in its heaviest form for maximum benching power.

c) With the use of special bars it can be used for curling weights. Eliminating the need for or at least curbing the amount of weights one needs store in a confined space. They can also be used in tandem on either side with small extension bars.

d) By varying the amount of flexibility in the multi-bell it could in its most simplistic mode be made with a simple transverse hole penetrating the heads to allow one to bench or use them by the more traditional methods a dumbbell might be used. ie) A professional gym might not want the small slugs strewn around their gym but would appreciate the flexibility of being able to press the multi-bell into service should there become a shortage of regular plates. Anyone that has gone to a gym has had this happen to them causing frustration and loss of time. Not to mention the stress of having to borrow or take them from someone else.

e) By varying the amount of flexibility in the multi-bell it could in its most simplistic mode be made with just a contoured permanent ring attached that could be held between the fingers. This would not impede its use as the individual would hold it with forethought of the lifting motion involved.

f). The multi-bell in whatever form could be used on most popular weight lifting machines by having them slide thru 2 bars. (One on each head to eliminate movement that might bother the would be lifter. On a bench, movement would be minimized by tightening or loosening the distance between multi-bells or using a plate for stability).

g) Another aspect that could be enjoyed by the multi-bell is the privacy in a gym of using it with a fashionably made durable rubber cover on each end that would make the multi-bell as follows.

1. Fashionable

2. Safer in that the material if made of rubber would make it easier on floors and individuals should the multi-bell come in contact with objects or people.

3. The never before realized fact that someone might not wish to have others know how much weight he or she is lifting (Privacy being an issue never addressed in public gyms). This is something I've never come across in a gym. People who lift heavy have always been the one to stand out making novices feel uncomfortable. The multi-bell could depending on attachments have an additional 20 or more pounds on them so one can see that in a social environment it may have its merit. As a bystander one needs to guess if an individual is lifting light or heavy weights. A small but admittedly welcome social advantage in at times stressful atmosphere.

4. Spinal problems caused by the constant bending over and lifting of flat heavy pieces of plate metal on the floor could be minimized by the tremendous increase in leverage that the shape of the multi-bell affords when used as a weight in benching.

The inventor believes that the multi-bell would be limited only by the imagination of the user and subsequent attachments that would be sold for them. The use of space age metals would make the multi-bell even more useful in that the flexibility of weight could be amplified accordingly with the materials used.

The invention may include the following additional characteristics separately or in combination.

1) Surfaces on multi-bell with and without weighted slugs to be contoured to fit more snugly against each other and allow for a certain amount of movement so multi-bells will not lock in uncomfortable angles when using them on a weight bench or stand.

2) Weighted slugs have a method of removal in case they become stuck. An alien key slut is used as default. (Allen wrench in ring adapter).

3) Weighted slugs may instead of being screw in type might have the feature of pressing button or lever on the head that would cause to extend a locking mechanism to extend along the shank of the weighted slug locking it in place in the multi-bell. The screw in type is used as default.

4) Ring adapters may or may not have locking mechanism on top. The default on drawings has one on top and another on bottom.

5) Covers on multi-bell could be cosmetic or of a strong protective material or combination thereof.

What is claimed is:

1. A weighted exercise device comprising:

a first multi-bell having an elongate central bar with a longitudinal axis and first and second ends, and a head mounted to each end of the elongate central bar;

each head having at least two threaded lateral holes therein with axes extending in different lateral directions with respect to the longitudinal axis; and a plurality of lateral weight slugs, each lateral weight slug having a size and shape configured to selectively engage a threaded hole and fit securely within any of said lateral holes.

2. The weighted exercise device of claim 1, wherein each head includes a longitudinal hole configured to securely receive any of said plurality of weight slugs.

3. The weighted exercise device of claim 2, wherein a longitudinal weight slug has a size and shape configured to engage the longitudinal hole, the longitudinal weight slug having a length longer than a lateral weight slug.

4. The weight exercise device of claim 3, wherein each longitudinal hole is threaded; and further including a lifting bar having opposite ends, each end of said lifting bar having threads for securely and releasably engaging a longitudinal threaded hole.

5. The weight lifting device of claim 4, further comprising:

a second multi-bell having an elongate central bar with a longitudinal axis and first and second ends, and a head mounted to each end of the elongate central bar;

each head having at least two threaded lateral holes therein with axes substantially perpendicular to the longitudinal axis configured to receive any of said lateral weight slugs; and a longitudinal hole in each head configured to securely receive any of said plurality of weight slugs.

6. The weight device of claim 4, further including a lifting bar having opposite ends, each end of said lifting bar configured to securely and releasably engage one of said holes of said heads.

7. The weight device of claim 1, further including a lifting bar having opposite ends, each end of the lifting bar configured to securely and releasably engage one of said holes of said heads.

8. The weight device of claim 1, wherein said elongate, central bar includes a central located aperture laterally therethrough.

9. The weight device of claim 8, further including a ring adapter having a first end configured to securely and releasably engage with said central aperture of said elongate, central bar.

10. The weight device of claim 9, wherein said ring adapter has a second end configured to releasably engage with a lifting bar.

11. The weight device of claim 1, wherein at least one of said at least two threaded, lateral holes of each head is a through hole with a diameter to permit the end of a lifting bar to pass therethrough.

12. The weight device of claim 1, further including a cover configured to removably fit over either head of the multi-bell.

* * * * *